US007987626B2

(12) United States Patent
Williams

(10) Patent No.: US 7,987,626 B2
(45) Date of Patent: Aug. 2, 2011

(54) CONFIGURABLE GUN CLEANING KIT CASE

(75) Inventor: Nicholas Williams, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 228 days.

(21) Appl. No.: 12/352,976

(22) Filed: Jan. 13, 2009

(65) Prior Publication Data

US 2010/0175296 A1 Jul. 15, 2010

(51) Int. Cl.
*F41A 29/00* (2006.01)
*B65D 85/20* (2006.01)

(52) U.S. Cl. ..... 42/95; 206/223; 206/373

(58) Field of Classification Search ..... 42/95; 206/373, 206/473, 487, 3; 190/102; 248/690; 24/115 H, 24/115 K See application file for complete search history.

(56) References Cited

U.S. PATENT DOCUMENTS 4,148,424 A 4/1979 Fortenberry
4,523,702 A * 6/1985 Viio ..... 224/101
4,716,673 A * 1/1988 Williams et al. ..... 42/95
4,901,464 A * 2/1990 Banoun ..... 42/95
5,127,179 A * 7/1992 Marsh ..... 42/90
5,370,288 A * 12/1994 Field ..... 224/223
5,588,242 A * 12/1996 Hughes ..... 42/95
5,655,272 A 8/1997 Young
5,855,274 A 1/1999 Piao
6,038,745 A 3/2000 Rapp
6,085,695 A 7/2000 Miller et al.
6,874,628 B2 * 4/2005 Hammill ..... 206/317
7,165,673 B2 1/2007 Marks
7,331,461 B2 2/2008 MacKinnon

OTHER PUBLICATIONS

International Search Report and Written Opinion mailed Mar. 23, 2010, (9 [pgs.).

* cited by examiner

*Primary Examiner* — Bret Hayes
(74) *Attorney, Agent, or Firm* — Harris Beach PLLC

(57) ABSTRACT

A firearm cleaning kit includes a case having first and second compartments joined along a fold line, and a fastener for joining together the first and second compartments. A tool compartment having at least one tool-holding cavity is secured to an interior region of the case, and a firearm cleaning tool is secured within the cavity. The kit further includes a length of material formed into a closed loop and attached to the case at a single point along the length of the loop. The kit further includes a divider piece having a single slot formed therethrough. Storage compartments are formed by the insertion of the loop of material through the slot in the divider piece. The divider piece is slideable along the length of the loop to make the storage compartments adjustable.

12 Claims, 3 Drawing Sheets

CONFIGURABLE GUN CLEANING KIT CASE

FIELD OF THE INVENTION

This invention relates generally to the field of firearm cleaning kits, and more particularly to a storage compartment for a firearm cleaning kit.

BACKGROUND OF THE INVENTION

Proper cleaning of a firearm after use is essential to ensuring the firearm retains its accuracy, safety, and reliability. With each firing, the breech and bore of a firearm accumulate residue such as powder, priming compound, and copper fragments from ammunition casings. In addition, environmental elements such dirt, snow, and moisture can accumulate in the bore, causing further fouling. Fouling and debris may also accumulate in the firearm's action due to its design, or improper maintenance. Failure to remove the residue and debris results in a decrease in the firearm's accuracy and precision, and may even pose a safety hazard to the operator. Therefore, proper cleaning is one of the most important elements of firearm ownership.

Civilians who shoot and clean firearms often devise their own storage cases to store firearm cleaning materials. An example is empty ammunition can. In many instances, firearm owners also fashion their own tools to aide in the cleaning process. However, these homemade storage cases and cleaning tools are generally not portable or lightweight. When cleaning a firearm, components or cleaning tools may be set aside during the cleaning process and, due to their small size, may be misplaced or lost. Therefore, civilians have a need for a lightweight and compact firearm cleaning kit that stores cleaning tools and provides additional storage capability.

Military personnel need to be able to clean their weapons in the field, preferably immediately after shooting so that their firearm is ready for use at all times. An important aspect of the cleaning process is that the cleaning kit be compact and lightweight, organized, and able to store firearm components or spare tools and cleaning supplies. Therefore, military personnel also need for a lightweight and compact firearm cleaning kit that stores cleaning tools and provides additional storage capability for the cleaning of military weapons.

To answer the need for portable, compact, and lightweight storage cases for firearm cleaning materials and tools, many different types of firearm cleaning kits have been designed for military and consumer use. Specialized, compact cleaning kits have been custom-designed to store the precise tools and components needed to thoroughly clean a particular firearm. For example, firearm cleaning tool kits have been designed to store specific cleaning tools such as brushes, picks, scrapers, and rods.

One drawback to current firearm cleaning kits is that they are relatively inflexible with regards to storing additional accessories, tools, and components. Compact cleaning kits place a premium on size, and typically have storage compartments only for the components sold with the case, thereby leaving no room for additional gear. Pockets may be sewn into a compact case, but pockets may not permit secure storage of tools or components that are different sizes. Other storage spaces such as foam cut-outs are ideal for a particular or specialized tool, but are inadequate for storing tools and components of varying size.

One cleaning kit in the prior art provides an elastic strap extending transversely across the inside of the case, sewn to the case at both ends, to hold additional cleaning materials such as bore solvent. Another firearm cleaning kit provides an elastic strap sewn into the inner fold of the case to permit temporary storage of tools while the user is cleaning the firearm. While both these straps attempt to provide flexibility in tool or component storage, they are deficient in that the strap is not adjustable. Therefore, the strap is only effective in holding either a single large component or multiple small components in a single group. If the strap is used to store multiple small components in a single group, and one or more components are removed, the remaining components will fall out.

SUMMARY OF THE INVENTION

In view of the background, it is therefore an object of the present invention to provide a firearm cleaning kit that includes adjustable compartments. Briefly stated, a firearm cleaning kit includes a case having first and second compartments joined along a fold line, and a fastener for joining together the first and second compartments. A tool compartment having at least one tool-holding cavity is secured to an interior region of the case, and a firearm cleaning tool is secured within the cavity. The kit further includes a length of material formed into a closed loop and attached to the case at a single point along the length of the loop. The kit further includes a divider piece having a single slot formed therethrough. Storage compartments are formed by the insertion of the loop of material through the slot in the divider piece. The divider piece is slideable along the length of the loop to make the storage compartments adjustable.

According to an embodiment of the invention, a firearm cleaning kit is provided wherein the tool compartment is attached at the fold line. The tool compartment includes a rigid plastic backing and at least one foam tool insert secured to the backing.

According to an embodiment of the invention, a firearm cleaning kit is provided that further includes a belt attachment attached to an exterior region of the case. The belt attachment includes a strip of fabric secured at each end to the case, an insert slideably received by the strip of fabric, and a belt loop disengageably secured to the insert.

BRIEF DESCRIPTION OF THE DRAWINGS

The novel features that are characteristic of the preferred embodiment of the invention are set forth with particularity in the claims. The invention itself may be best be understood, with respect to its organization and method of operation, with reference to the following description taken in connection with the accompanying drawings in which:

DETAILED DESCRIPTION OF THE PREFERRED EMBODIMENT

Figure 1:
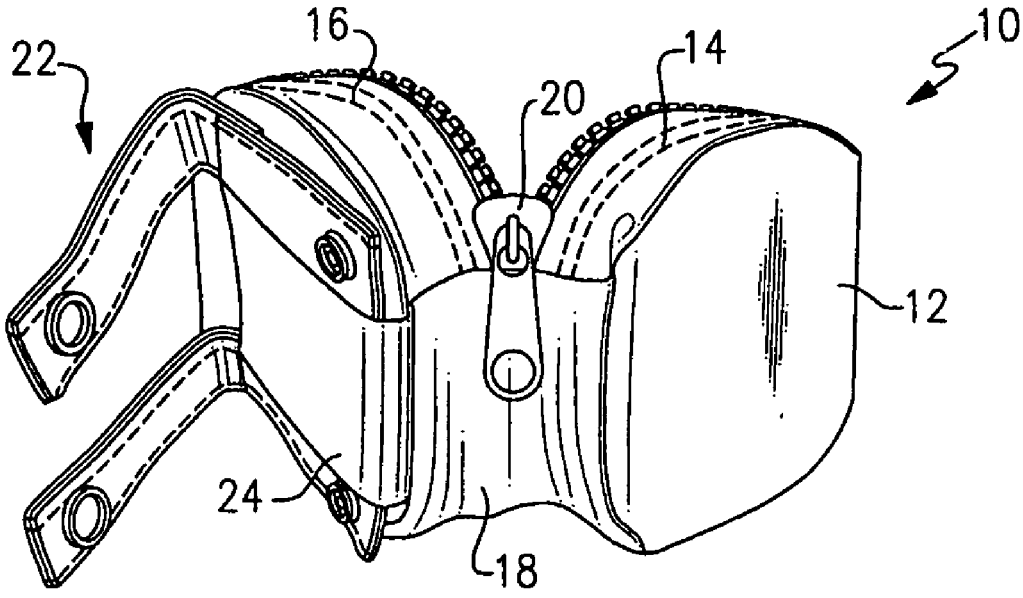
FIG. 1 shows a perspective exterior view of a firearm cleaning kit according to an embodiment of the invention.

Referring to FIG. 1 of the drawings, an exterior view of a firearm cleaning kit 10 is shown. A case 12 includes a first compartment 14 and a second compartment 16 separated by a fold line 18. The fold line 18 joins the first compartment 14 to the second compartment 16, allowing the two to be folded up in a clamshell-type arrangement. In the embodiment shown, the case 12 is generally circular in shape, but any shape that permits the first compartment 14 and the second compartment 16 to be folded together in clamshell fashion is suitable. For example, the case 12 could be square or rectangular in shape, with one side serving as the fold line 18. The case 12 may be made from a soft, durable fabric, or may be a rigid, hard shell construction if increased toughness is required. In the embodiment shown, the case 12 is constructed of nylon fabric to allow some compression.

The kit 10 further includes a fastener 20 to secure the first compartment 14 to the second compartment 16 when the case 12 is in the closed position. The fastener 20 in the disclosed embodiment is a zipper, configured to zip along three sides of the case 12. Other fastener configurations are possible. For example, the fastener 20 may be one or more snaps, flexible strips such as VELCRO® brand fasteners, or ties. The fastener 20 in the preferred embodiment is a silent zipper due to its strength, ease of use, and quiet operation.

Figure 2:
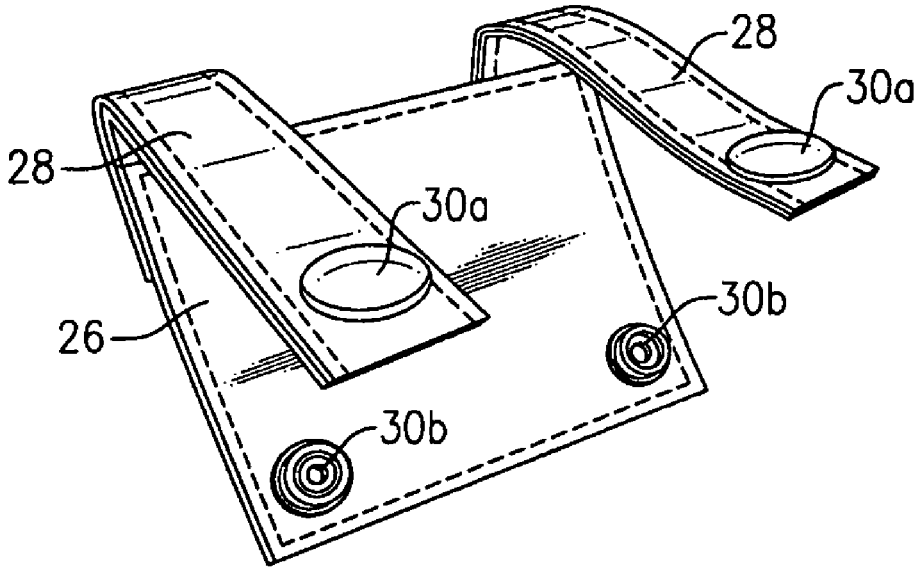
FIG. 2 shows a perspective view of the belt attachment shown in FIG. 1.

Referring to FIGS. 1 and 2, the kit 10 further includes a belt attachment 22 affixed to the exterior of the second compartment 16 of case the 12. In one embodiment, the belt attachment 22 comprises a rugged strip of nylon fabric 24 secured at each end to the case 12, thereby forming a loop through which a belt (not shown) may be passed. In a preferred embodiment, the belt attachment 22 further includes an insert 26 having a planform approximately equal to the exterior of the second compartment 16. The insert 26 is positioned through the loop made by the fabric 24. Secured to the insert 26 are two belt loops 28, 28 Unlike the loop formed by the fabric, each belt loop 28 is disengageable with the insert 26. In this manner, the belt attachment 22 may be wrapped around the belt and secured, rather than inserting the belt through a fixed loop. In the preferred embodiment shown, each belt loop 28 is made of rugged nylon and sewn to the insert 26 at one end, and configured with a snap 30 at the other end. Other means of configuring a disengageable belt loop 28 are possible; for example the snap 30 may be replaced by VELCRO® brand fasteners. The belt attachment 22 may be affixed to any of portion the case 12 depending on the particular need of the user. For example, the belt attachment 22 may be affixed to the first compartment 14 or the fold line 18.

Figure 3:
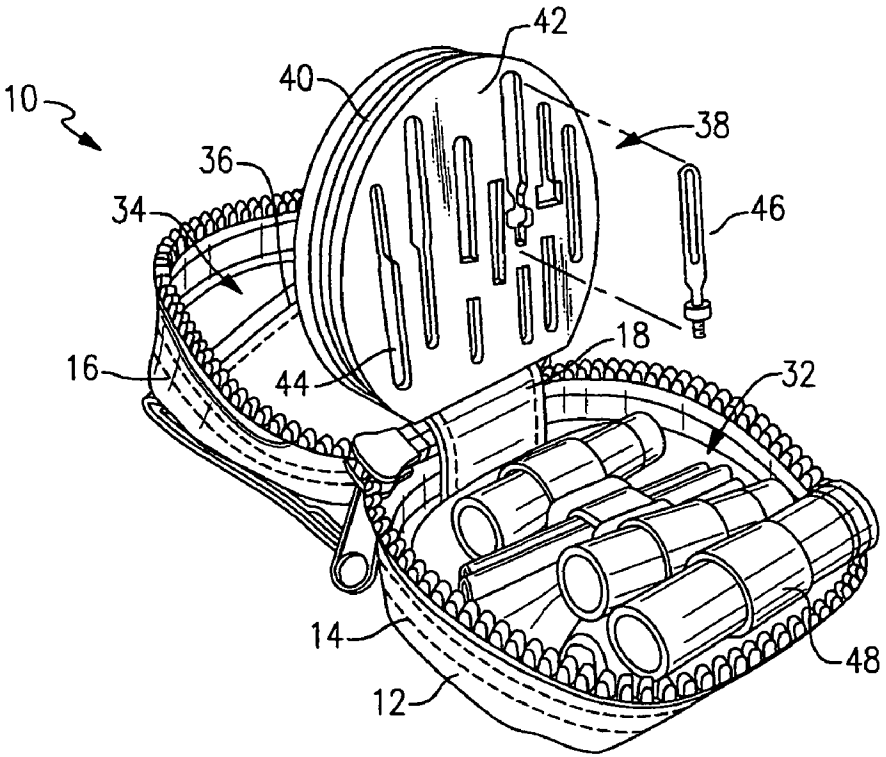
FIG. 3 shows a perspective interior view of the firearm cleaning kit shown in FIG. 1.

Referring to FIG. 3, an interior view of the firearm cleaning kit 10 is shown. The case 12 includes a first interior region 32 defined by the first compartment 14, and a second interior region 34 defined by the second compartment 16. A pocket 36 sewn into the first interior region 32 and/or the second interior region 34 of case 12 holds cleaning materials such as a flexible cleaning rod and bore patches (not shown).

The kit 10 further includes a tool compartment 38 secured to the fold line 18 of the case 12. In the disclosed embodiment, the tool compartment 38 comprises a backing 40 and at least one tool insert 42. The backing 40 is made of a thin, rigid plastic. The tool insert 42 is secured to the backing 40, and is preferably composed of foamed rubber. The tool insert 42 contains a plurality of tool-holding cavities 44 to hold respective cleaning tools 46 therein. The tool compartment 38 may also be secured to the first interior region 32 and/or the second interior region 34 of the case 12.

The tool-holding cavities 44 are individually sized to securely hold a particular type of cleaning tool 46. For example, the cleaning tools 46 may include flexible cleaning rods, an arbor, a plug, and/or a patch or swab to be used in cleaning the bore of a firearm. The cleaning tool 46 may further include one or more bore brushes for removing loose dirt, powder, priming compound, and copper fragments from the firearm bore. Other examples of cleaning tools 46 include slotted tips, picks, adapters, handles, obstruction removers, mats, and scrapers. The cleaning tool 46 may further include a tool to aide in bore inspection, such as a bore reflector.

Figure 4:
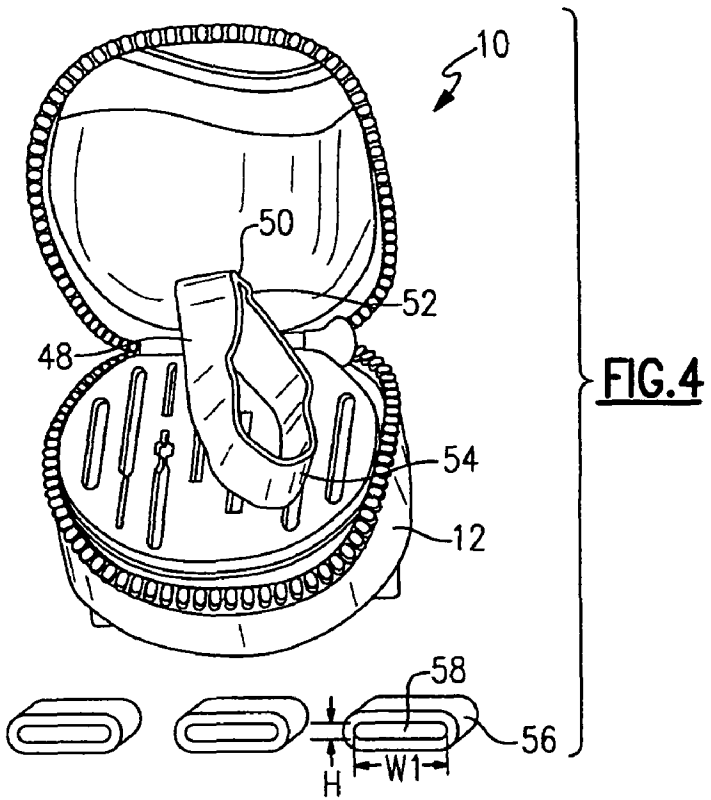
FIG. 4 shows a perspective view of the loop and the divider piece shown in FIG. 1.

Referring to FIG. 4, the kit 10 further includes a length of material 48 formed into a closed loop, hereinafter referred to as loop 50. The loop 50 is affixed to the case 12 at a single point along the length of the loop, hereinafter referred to as the fixed end 52, leaving a free end 54 distal to the fixed end 52. The width of the material 48 is substantially greater than the material thickness, so as to aide in forming a storage compartment, as will be discussed below. In the disclosed embodiment, the material 48 is elastic, approximately 0.75 inches in width, and approximately 0.045 inches thick. The length of the material is such that when doubled over to form the loop, the loop nests into case 12. The loop 50 may be fixed to the case 12 at any convenient location. In the disclosed example, the loop 50 is affixed to the fold line 18. However, the loop 50 may be affixed to the first or second interior region, or the exterior of the case.

Still referring to FIG. 4, a divider piece 56 is shown having a single slot 58 therethrough. The slot width, shown as W1, is slightly greater than the width of material 48. In the disclosed embodiment, the width W1 of the slot 58 is approximately 0.80 inches. The slot height, shown as H, is dimensioned to be no more than twice the thickness of material 48. In the disclosed embodiment, the height H of slot 58 is approximately 0.08 inches.

Figure 5:
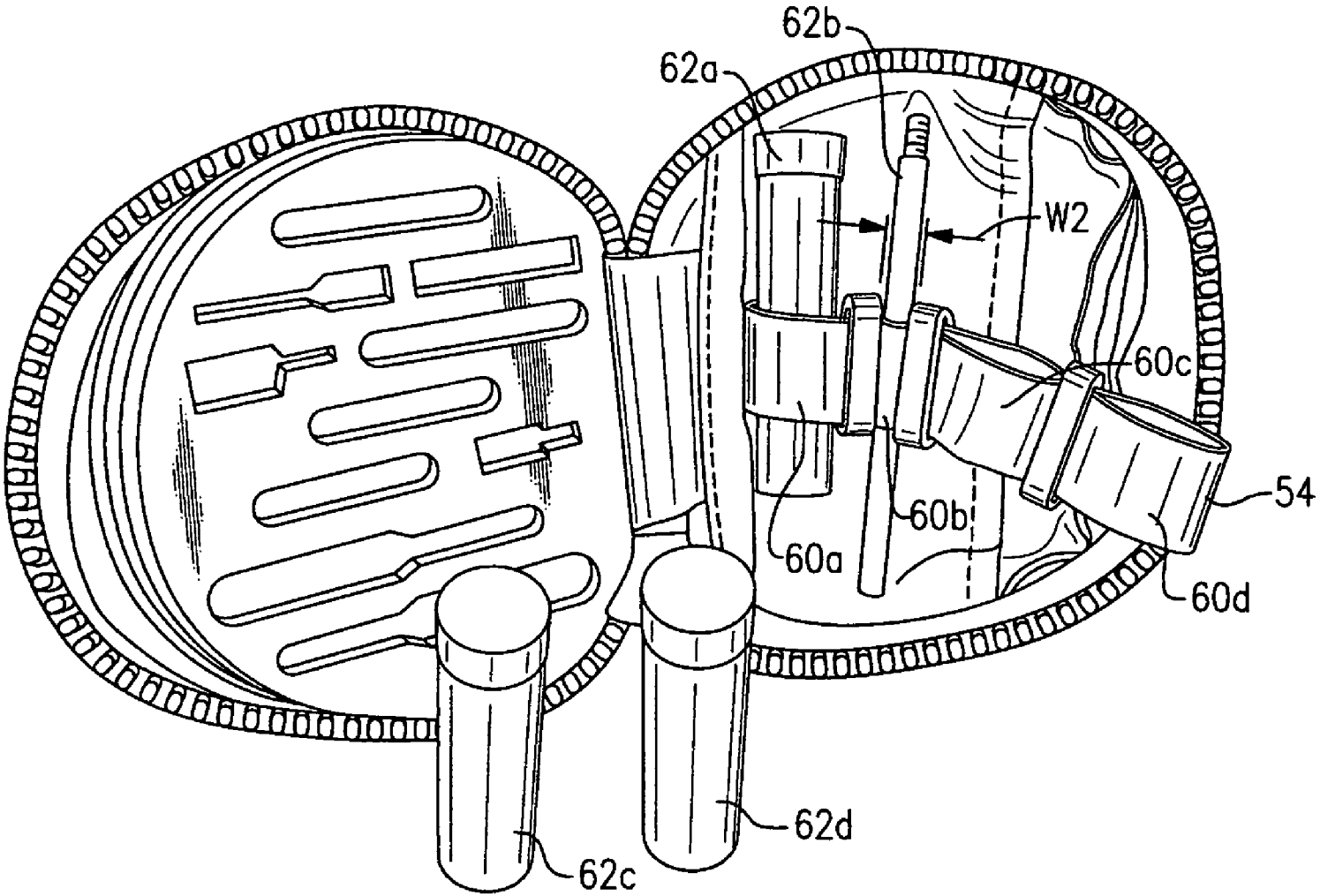
FIG. 5 shows a perspective view of the adjustable storage compartments shown in FIG. 1.

The divider piece 56 coupled with a portion of the loop 50 forms an adjustable storage compartment 60. Referring to FIGS. 4 and 5, a plurality of storage compartments 60*a*-60*d* are shown. The storage compartment 60 is formed by inserting the free end 54 of the loop 50 through the slot 58 in the divider piece 56, and sliding the divider piece 56 along the length of the loop 50 until the desired width is achieved. Since the width W1 of the slot 58 is slightly larger than the width of the material 48, and the slot height H is no more than twice the thickness of material 48, the doubled-over thickness of the material 48 forming the loop 50 causes a slight friction fit in the slot 58. In this way, the divider piece 56 is able to slide along the length of the loop 50 with a small amount of force, e.g., greater than the friction force, but is held in place when the sliding force is released. By virtue of this configuration, the width W2 of the storage compartment 60 is both adjustable and self-locking. In the preferred embodiment, the doubled-over thickness of material 48 is approximately 0.09 inches, or 0.01 inches greater than the height H of the slot 58. In order to insert the loop 50 through the slot 58, the elastic material 48 must be stretched to decrease its thickness.

One advantage of the adjustable storage compartment is that tools or components 62 remain secured even if one or more items are removed from other storage compartments. In the strap configuration found in the prior art, the design of the strap necessitated that multiple components be grouped together and secured in a single group. Removal of one or more components from the group would create sufficient slack in the strap to cause the remaining items to fall out. This is undesirable since many of the tools used to clean a firearm are very small and intricate, and are easily lost in a wooded environment, for example. As best seen with reference to FIG. 5, two components 62*c* and 62*d* have been removed from storage compartment 60*c* and 60*d*, respectively. Unlike the strap utilized in prior art firearm cleaning kits, the remaining components 62*a* and 62*b* stored in compartments 60*a* and 60*b*, respectively, remain securely in place.

Due to the adjustable nature of the compartment 60, a wide variety of components 62 are capable of being stored in the firearm cleaning kit 10. In addition to the cleaning tools 46 described above, the component 62 may further include a capped vial, as shown in FIG. 5. The vial may hold a cleaning brush or other cleaning tool 46, or small caliber ammunition, for example. The component 62 may further include a tube of solvent and/or lubricant, a small flashlight, or personal items, for example.

Another advantage of the disclosed firearm cleaning kit 10 is that it accommodates various sizes of tools or components, thereby allowing a user to store firearm components while the firearm is being cleaned. Still referring to FIG. 5, storage compartment 60*b* is shown storing a section of a connectable rod 64 used to clean the bore of a firearm. The width W2 of storage compartment 60*b* is configured much narrower than the other storage compartments. And, because the width of the elastic material 48 is substantially greater than the material thickness, the width serves to form the height of the storage compartment 60. In this manner, the wider the material 48 is selected, the better it will function in its storage capacity. Further, because the material 48 in the disclosed embodiment is elastic, it stretches over the rod 64 to grip it more securely.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

I claim:

1. A firearm cleaning kit comprising:

a case having first and second compartments joined along a fold line;

a fastener for joining together the first and second compartments of the case;

a tool compartment secured to an interior region of the case, the tool compartment having at least one tool-holding cavity;

a firearm cleaning tool secured within the at least one tool-holding cavity; and a length of material formed into a closed loop, the closed loop having a fixed end and an opposing free end, the fixed end affixed to the case at a single point along the length of the loop, the material width being substantially greater than the material thickness;

wherein the improvement comprises:

a divider piece coupled to a portion of the loop, the divider piece having a single slot formed therethrough, the slot being approximately the same width as the material formed into the closed loop, the height of the slot being substantially less than the width of the slot; and a plurality of storage compartments having adjustable widths, the storage compartments being formed by the insertion of the free end of the loop of material through the slot in the divider piece, the divider piece being slidable along the length of the loop.

2. The firearm cleaning kit of claim 1 wherein the tool compartment is secured to the fold line.

3. The firearm cleaning kit of claim 1 wherein the length of material is sufficiently elastic so as to secure tools or components when one or more items are removed from other storage compartments.

4. The firearm cleaning kit of claim 3 wherein the thickness of the elastic material is more than half the height of the slot.

5. The firearm cleaning kit of claim 1 wherein the loop of material is affixed to the interior region of the case.

6. The firearm cleaning kit of claim 5 wherein the loop of material is affixed to the case at the fold line.

7. The firearm cleaning kit of claim 1 further comprising a plurality of divider pieces in slidable engagement with the length of material.

8. The firearm cleaning kit of claim 1 further comprising a belt attachment affixed to an exterior region of the case.

9. The firearm cleaning kit of claim 8 wherein the belt attachment comprises a strip of fabric secured at each end to the case, an insert slideably received by the strip of fabric, and a belt loop disengageably secured to the insert.

10. The firearm cleaning kit of claim 1 wherein the divider piece is adapted to be self-locking on the length of material.

11. The firearm cleaning kit of claim 1 wherein the tool compartment further comprises a backing secured to the fold line, the tool compartment having at least one foam tool insert secured to the backing, the at least one foam tool insert having a plurality of tool-holding cavities.

12. A firearm cleaning kit comprising:

a case having first and second compartments joined along a fold line;

a fastener for joining together the first and second compartments of the case;

a tool compartment comprising a rigid backing secured to the fold line and at least one foam tool insert secured to the backing, the at least one foam tool insert having a plurality of tool-holding cavities;

a firearm cleaning tool secured within one of the tool-holding cavities;

a length of material formed into a closed loop, the closed loop having a fixed end and an opposing free end, the fixed end affixed to the case at a single point along the length of the loop, the material width being substantially greater than the material thickness;

a divider piece coupled to a portion of the loop, the divider piece having a single slot formed therethrough, the slot being approximately the same width as the material formed into the closed loop, the height of the slot being substantially less than the width of the slot;

a plurality of storage compartments having adjustable widths, the storage compartments being formed by the insertion of the free end of the loop of material through the slot in the divider piece, the divider piece being slidable along the length of the loop; and a belt attachment affixed to the exterior region of the case, the belt attachment comprising a strip of fabric secured at each end to the case, an insert slideably received by the strip of fabric, and a belt loop disengageably secured to the insert.

* * * * *